US009611117B2

(12) United States Patent
Asamura

(10) Patent No.: US 9,611,117 B2
(45) Date of Patent: Apr. 4, 2017

(54) MEDIUM PROCESSING DEVICE AND MEDIUM TRANSACTION DEVICE

(71) Applicant: Oki Electric Industry Co., Ltd., Tokyo (JP)

(72) Inventor: Masamitsu Asamura, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/652,056

(22) PCT Filed: Nov. 18, 2013

(86) PCT No.: PCT/JP2013/081045

§ 371 (c)(1),
(2) Date: Jun. 12, 2015

(87) PCT Pub. No.: WO2014/097794

PCT Pub. Date: Jun. 26, 2014

(65) Prior Publication Data

US 2016/0052741 A1 Feb. 25, 2016

(30) Foreign Application Priority Data

Dec. 20, 2012 (JP) ..... 2012-278448

(51) Int. Cl.
*B65H 29/12* (2006.01)
*B65H 29/00* (2006.01)
(Continued)

(52) U.S. Cl.
CPC ..... *B65H 29/006* (2013.01); *B65H 29/52* (2013.01); *B65H 29/58* (2013.01); *B65H 43/04* (2013.01);
(Continued)

(58) Field of Classification Search
CPC ..... B65H 29/006; B65H 29/52; B65H 43/04; B65H 2511/528; B65H 2511/52;
(Continued)

(56) References Cited

U.S. PATENT DOCUMENTS 6,139,011 A * 10/2000 Huang ..... B65H 5/062 271/114
8,215,579 B2 * 7/2012 Mizoro ..... B65H 29/006 242/528
(Continued)

FOREIGN PATENT DOCUMENTS

CN 102667879 A 9/2012
JP 2010-001123 A 1/2010
(Continued)

*Primary Examiner* — Ernesto Suarez
(74) *Attorney, Agent, or Firm* — Rabin & Berdo, P.C.

(57) ABSTRACT

An operation knob that turns a drum is exposed at the outer side of a left side face of a temporary holding section, and a knob cover is disposed at the outer side of the operation knob. When an opening guide of the temporary holding section is in a closed state and is closed onto the upper side of the drum, the knob cover is put into a covering state, via a stud, preventing operation of the operation knob. When the opening guide of the temporary holding section is turned in an opening direction from the closed state and opens apart from the upper side of the drum, the knob cover is turned in an exposing direction by the action of a spring and put into an exposing state.

11 Claims, 12 Drawing Sheets

(51) Int. Cl.
*B65H 29/58* (2006.01)
*B65H 43/04* (2006.01)
*B65H 29/52* (2006.01)

(52) U.S. Cl.
CPC ..... *B65H 2301/4191* (2013.01); *B65H 2301/41912* (2013.01); *B65H 2402/441* (2013.01); *B65H 2407/20* (2013.01); *B65H 2511/20* (2013.01); *B65H 2511/528* (2013.01); *B65H 2601/11* (2013.01); *B65H 2601/25* (2013.01); *B65H 2601/255* (2013.01); *B65H 2701/1912* (2013.01)

(58) Field of Classification Search
CPC ..... B65H 2601/11; B65H 2601/25; B65H 2601/255; B65H 2601/30; B65H 2601/31; B65H 2601/32; B65H 2601/321; B65H 2601/325; B65H 2601/326; B65H 2407/20; B65H 2407/50; B65H 2301/4191; B65H 2301/41912; B65H 2301/419; B65H 2402/412; B65H 2402/441
See application file for complete search history.

(56) References Cited

U.S. PATENT DOCUMENTS

| | | | | |
|---|---|---|---|---|
| 8,360,223 | B2 * | 1/2013 | Iwatsuki | B65H 29/006 194/206 |
| 8,702,088 | B2 * | 4/2014 | Kashiwabuchi | B65H 29/006 271/10.04 |
| 8,833,537 | B2 * | 9/2014 | Kashiwabuchi | B65H 5/28 194/206 |
| 8,844,805 | B2 * | 9/2014 | Yokote | G07D 11/0006 235/379 |
| 8,967,612 | B2 * | 3/2015 | Yokote | G07D 11/0081 271/273 |
| 2011/0079675 | A1 | 4/2011 | Iwatsuki et al. | |
| 2012/0255832 | A1 | 10/2012 | Kashiwabuchi | |

FOREIGN PATENT DOCUMENTS

| | | | | |
|---|---|---|---|---|
| JP | 2011-134222 | A | 7/2011 | |
| JP | WO 2013014985 | A1 * | 1/2013 | B65H 5/28 |

* cited by examiner

MEDIUM PROCESSING DEVICE AND MEDIUM TRANSACTION DEVICE

TECHNICAL FIELD

The present invention relates to a medium processing device and a medium transaction device, and is excellently applied to, for example, an automatic teller machine (ATM) or the like in which mediums such as banknotes or the like are inserted and desired transactions are carried out.

BACKGROUND ART

Heretofore, an ATM or the like that is used in a financial institution or the like is configured such that, in accordance with the details of a transaction with a customer, cash—for example, banknotes and coins or the like—is deposited by the customer or cash is withdrawn by the customer.

An ATM has been proposed that includes: a banknote deposit and withdrawal aperture that, for example, transfers banknotes to and from customers; a verification section that verifies the denominations of deposited banknotes and whether the banknotes are authentic; a temporary holding section that temporarily retains the deposited banknotes; and banknote cassettes that store the banknotes of the respective denominations.

In a deposit transaction, when a customer deposits banknotes in the banknote deposit and withdrawal aperture, this ATM verifies the deposited banknotes at the verification section, and stores banknotes that are verified as being authentic in the temporary holding section. Meanwhile, banknotes that are verified as not being suitable for the transaction are returned to the banknote deposit and withdrawal aperture and returned to the customer. Then, when the customer has verified a deposit amount, the banknotes stored in the temporary holding section are fed out, the denominations of the banknotes are re-verified at the verification section, and the banknotes are stored in the banknote cassettes in accordance with the verified denominations.

The temporary holding section is, for example, a section that includes a cylindrical drum that turns, two long tapes, one ends of which are superposed and fixed at a periphery side face of the drum, two reels around which the tapes are wound, and a motor that turns the drum, the reels and the like.

When this temporary holding section is to store a banknote, the banknote is transferred from a conveyance section, the banknote is nipped between the two tapes, and the drum is turned in a predetermined winding direction by the motor. Thus, the banknote is wound onto the periphery side face of the drum together with the two tapes.

When the temporary holding section is to feed out a stored banknote, the reels are turned to wind up the respective tapes, and the drum is turned by the motor in an unwinding direction, which is opposite to the winding direction. Thus, the banknote is separated from the periphery side face of the drum and is transferred to the conveyance section.

An operation knob for maintenance operations is provided in the temporary holding section, at an outer side face or the like (for example, see Japanese Patent Application Laid-Open (JP-A) No. 2011-134222). The operation knob is configured to operate in conjunction with the drum. When the operation knob is turned by an operator during maintenance operations or the like, the drum may be turned manually.

SUMMARY OF INVENTION

Technical Problem

In the temporary holding section, banknotes may catch on neighboring components and the like—between the drum and the neighboring components and the like, in a conveyance path along which the banknotes are conveyed inside the temporary holding section, and the like—and there may be occurrences of jamming.

If the operation knob of the temporary holding section is turned in this situation, the drum is turned, as a result of which further banknotes may be fed to the location at which the jam has occurred. Thus, the degree of jamming may become more severe, or the tapes may be taken in and become jammed, and damage may be caused to the banknotes, the components and so forth.

The present invention has been made in consideration of the problem described above; a medium processing device and medium transaction device that may prevent damage to equipment and mediums during maintenance operations are proposed.

Solution to Problem

To solve the problem, a medium processing device according to the present invention includes: a drum in a cylindrical shape, sheet-form mediums being wound onto a periphery side face of the drum; a frame that screens the surroundings of the drum from outside the frame, an opening hole through which the mediums can be extracted to the outside being formed in the frame; a guide that guides the mediums in a vicinity of the periphery side face of the drum; a support portion that supports the guide to be switchable between a closed state in which the opening hole is covered by the guide and an open state in which the opening hole is open; an operation knob provided at one side face of the frame, the operation knob transmitting a turning operation applied from the outside to the drum; and a knob cover that is in a covering state of covering the operation knob when the guide is in the closed state, and that is in an exposing state in which the operation knob is exposed when the guide is not in the closed state.

Thus, when the guide is in the closed state and the opening hole is closed, the operation knob is covered by the knob cover, operation of the operation knob is inhibited, and manual operation of the drum may be disabled. Therefore, the possibility of a degree of jamming being worsened rather than the mediums being taken out through the opening hole may be prevented.

Further, a medium transaction device according to the present invention includes: a conveyance section that conveys sheet-form mediums; a drum in a cylindrical shape, the mediums being wound onto a periphery side face of the drum; a frame that screens the surroundings of the drum from outside the frame, an opening hole that opens to the outside being formed in a portion of the frame; a guide that guides the mediums between the conveyance section and a vicinity of the periphery side face of the drum; a support portion that supports the guide to be switchable between a closed state in which the opening hole is covered by the guide and an open state in which the opening hole is open; an operation knob provided at one side face of the frame, the operation knob transmitting a turning operation applied from the outside to the drum; and a knob cover that is in a covering state of covering the operation knob when the guide is in the closed state, and that is in an exposing state in which the operation knob is exposed when the guide is not in the closed state.

Thus, when the guide is in the closed state and the opening hole is closed, the operation knob is covered by the knob cover, operation of the operation knob is inhibited, and manual operation of the drum may be disabled. Therefore, the possibility of a degree of jamming being worsened rather than the mediums being taken out through the opening hole may be prevented.

Advantageous Effects of Invention

According to the present invention, when the guide is in the closed state and the opening hole is closed, the operation knob is covered by the knob cover, operation of the operation knob is inhibited, and manual operation of the drum may be disabled. Therefore, the possibility of a degree of jamming being worsened rather than the mediums being taken out through the opening hole may be prevented. Thus, the present invention may realize a medium processing device and medium transaction device that may prevent damage to equipment and mediums during maintenance operations.

DESCRIPTION OF EMBODIMENTS

Herebelow, modes for carrying out the invention (referred to as embodiments hereinafter) are described using the attached drawings.

1. First Embodiment

—1-1. Overall Structure of an Automatic Teller Machine—

Figure 1:
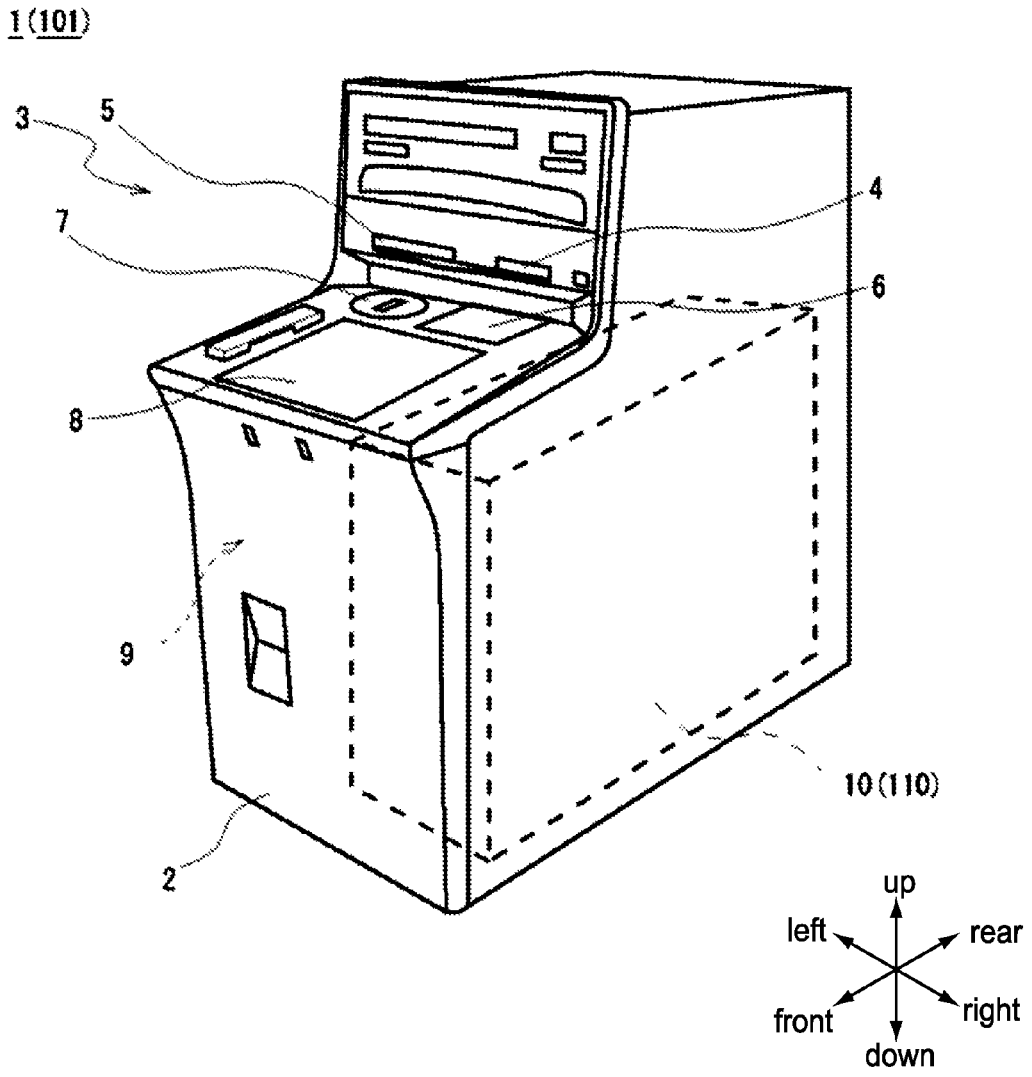
FIG. 1 is a schematic perspective view showing external structures of an ATM.

As shown by the exterior in FIG. 1, an automatic teller machine 1 is basically structured by a box-shaped casing 2. The automatic teller machine 1 is disposed in, for example, a financial institution or the like, and is configured to conduct transactions relating to cash with customers, such as deposit transactions, withdrawal transactions and the like.

The casing 2 has a shape in which a front side thereof is recessed at an angle at a location at which a customer standing in front of the casing 2 may easily insert banknotes, operate the automatic teller machine 1 through a touch panel and the like; that is, this location is a region extending from an upper portion of the front face of the casing 2 to an upper face of the casing 2. A customer service section 3 is provided in this region.

The customer service section 3 is provided at an upper-front side portion of the casing 2. The customer service section 3 is configured so as to directly give and receive cash, bank books and the like to and from customers, and to give information about transactions and receive operational instructions.

In the customer service section 3, a card insertion and ejection aperture 4 and a bank book insertion and ejection aperture 5 are provided so as to face forward, and a banknote deposit and withdrawal aperture 6, a coin deposit and withdrawal aperture 7, and a display and operation section 8 are provided so as to face upward.

The card insertion and ejection aperture 4 is a section at which various cards such as cash cards and the like are inserted and ejected. A card processing section is disposed behind the card insertion and ejection aperture 4. The card processing section reads account numbers and the like that are magnetically recorded on the various cards.

The bank book insertion and ejection aperture 5 is a section at which bank books are inserted and ejected. A bank book processing section is disposed behind the bank book insertion and ejection aperture 5. The bank book processing section reads information magnetically recorded in the bank books, prints transaction details in the bank books, and so forth.

The banknote deposit and withdrawal aperture 6 is a section at which customers insert banknotes to be deposited and at which banknotes being withdrawn by customers are ejected. The banknote deposit and withdrawal aperture 6 is opened and closed by driving of a shutter.

The coin deposit and withdrawal aperture 7 is a section at which customers insert coins to be deposited and at which coins being withdrawn by customers are ejected. Similarly to the banknote deposit and withdrawal aperture 6, the coin deposit and withdrawal aperture 7 is opened and closed by driving of a shutter.

The display and operation section 8 is formed of a liquid crystal display (LCD) that displays operation screens during transactions, and a touch panel in which touch sensors are integrated, at which various transaction selections, PIN numbers, transaction amounts and the like are entered.

Herebelow, descriptions are given with the side of the automatic teller machine 1 that a customer faces being defined as the front side, the opposite side being defined as the rear side, the left and right as viewed by a customer facing the front side being defined as the left side and the right side, and the upper side and the lower side being defined thus.

A main control section 9, a banknote deposit and withdrawal apparatus 10 and the like are disposed inside the casing 2. The main control section 9 supervises and controls the automatic teller machine 1 as a whole. The banknote deposit and withdrawal apparatus 10 performs various processes on the banknotes.

The main control section 9 is structured around a central processing unit (CPU), which is not shown in the drawings.

The main control section 9 reads a predetermined program from a ROM, flash memory or the like, which is not shown in the drawings, and executes the program. Thus, various processes such as deposit transactions, withdrawal transactions and the like are carried out.

The main control section 9 includes a memory section thereinside, which is random access memory (RAM), a hard disc drive, flash memory or the like. Various kinds of information are memorized in this memory section.

Further, the casing 2 is structured with openable and closeable doors in portions of side faces at the front face side and the rear face side thereof or the like. That is, at times of transaction operations at which transactions relating to cash are being conducted with customers, banknotes stored inside the banknote deposit and withdrawal apparatus 10 are protected by the doors of the casing 2 being closed, as represented in FIG. 1. In contrast, at times of maintenance operations at which maintenance operations are being carried out by a technician or the like, the doors are opened as required, and operations on the respective sections inside the casing 2 may be carried out with ease.

Figure 2:
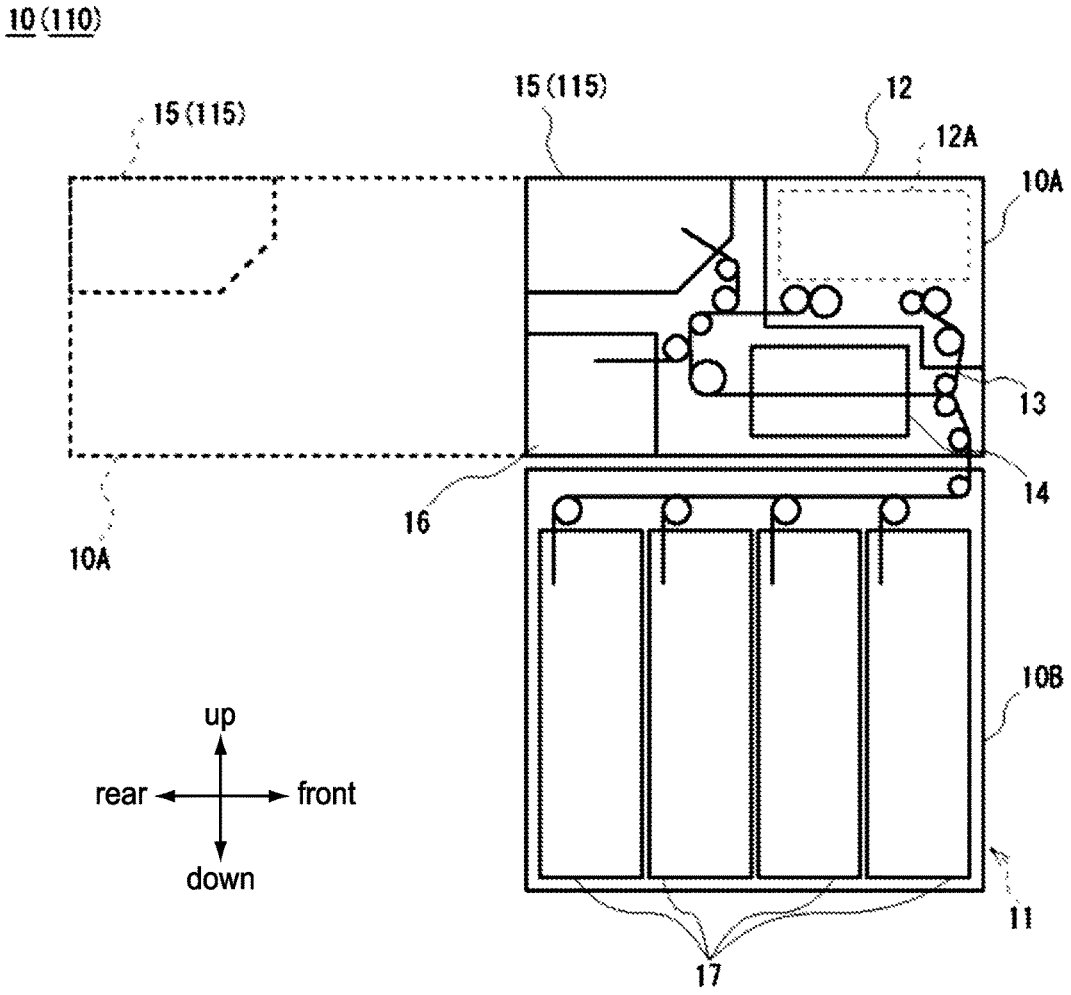
FIG. 2 is a schematic view showing the structure of a banknote deposit and withdrawal apparatus.

As shown in a side view in FIG. 2, the banknote deposit and withdrawal apparatus 10 is broadly divided to be structured by an upper side unit 10A at the upper side and a lower side unit 10B at the lower side. Plural numbers of sections that apply various processes to banknotes are incorporated inside each of these units. The respective sections of the banknote deposit and withdrawal apparatus 10 are controlled by a banknote control section 11.

Similarly to the main control section 9, the banknote control section 11 is structured around a central processing unit (CPU), which is not shown in the drawings. The banknote control section 11 reads a predetermined program from a ROM, Flash memory or the like, which is not shown in the drawings, and executes the program. Thus, various processes are carried out, such as processing to determine conveyance destinations of banknotes and the like.

The banknote control section 11 also includes a memory section thereinside, which is RAM, flash memory or the like. Various kinds of information are memorized in this memory section.

For example, when a customer is performing a deposit transaction to deposit banknotes, after receiving a predetermined operation command via the display and operation section 8, the banknote control section 11 opens the shutter of the banknote deposit and withdrawal aperture 6 and allows banknotes to be inserted into a deposit and withdrawal section 12.

When the banknotes are inserted into a container 12A of the deposit and withdrawal section 12, the deposit and withdrawal section 12 closes the shutter of the banknote deposit and withdrawal aperture 6, extracts the banknotes from the container 12A one at a time, and transfers the banknotes to a conveyance section 13. The conveyance section 13 advances the banknotes, which are structured in rectangular sheet shapes, in the direction of short sides thereof and conveys the banknotes to a verification section 14.

The verification section 14, while conveying the banknotes thereinside, uses optical components, magnetic sensing components and the like to verify the denominations and authenticity of the banknotes, and levels of damage and the like. The verification section 14 reports the verification results to the banknote control section 11. In response, the banknote control section 11 determines conveyance destinations of the banknotes in accordance with the acquired verification results.

The conveyance section 13 conveys banknotes that are verified as being proper banknotes by the verification section 14 to a temporary holding section 15 or the like and the banknotes are temporarily retained therein. Meanwhile, the conveyance section 13 conveys reject banknotes that should not be used in a transaction to the deposit and withdrawal section 12 and returns them to the customer.

Thereafter, via the display and operation section 8, the banknote control section 11 prompts the customer to confirm the deposited amount. The banknotes held at the temporary holding section 15 are conveyed to the verification section 14 by the conveyance section 13, and the denominations, levels of damage and the like are verified again. Thus verification results are acquired.

If the level of damage to a banknote is great, the banknote control section 11 determines that this banknote should not be re-used. The banknote is conveyed to a reject cassette 16 by the conveyance section 13 and stored. When the level of damage to a banknote is slight, the banknote control section 11 determines that the banknote should be re-used, and the banknote is conveyed by the conveyance section 13 and stored in a banknote cassette 17 corresponding to the denomination of the banknote.

During maintenance operations and the like of the banknote deposit and withdrawal apparatus 10, if, for example, a rear door of the casing 2 (see FIG. 1) is opened, the upper side unit 10A and lower side unit 10B each may be slid in the rearward direction. In FIG. 2, a state in which the upper side unit 10A has been slid in the rearward direction is shown by broken lines.

—1-2. Structure of the Temporary Holding Section—

Figure 3:
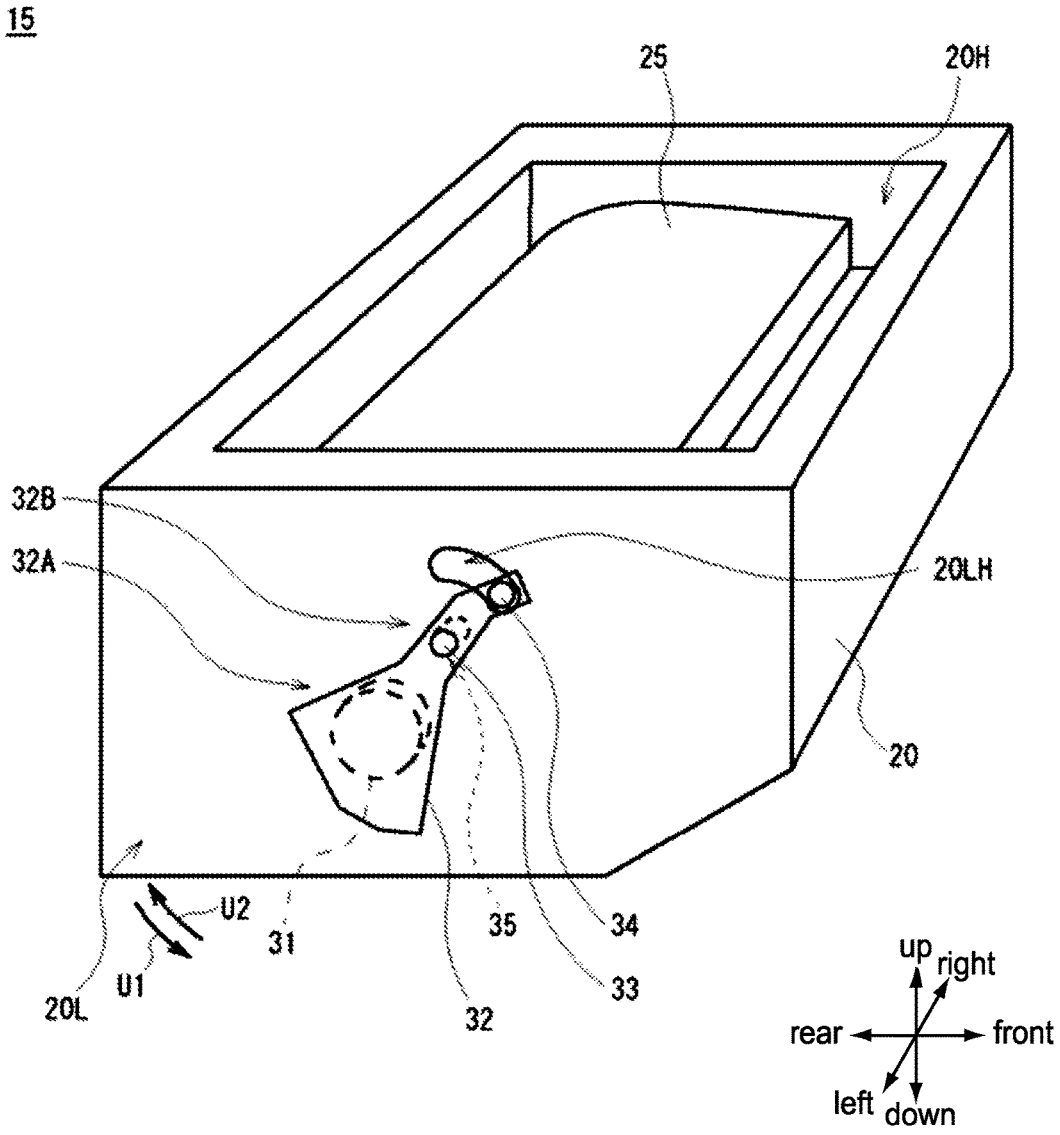
FIG. 3 is a schematic perspective view showing the structure of a temporary holding section in accordance with a first embodiment.

As shown in FIG. 3, the temporary holding section 15 has a structure in which the outer side is covered by a frame 20 and respective components are mounted thereinside.

A large hole portion 20H is formed in an upper face of the frame 20, over almost the whole area of the upper face. An interior space inside the frame 20 and an exterior space are in communication via the hole portion 20H.

Figure 4:
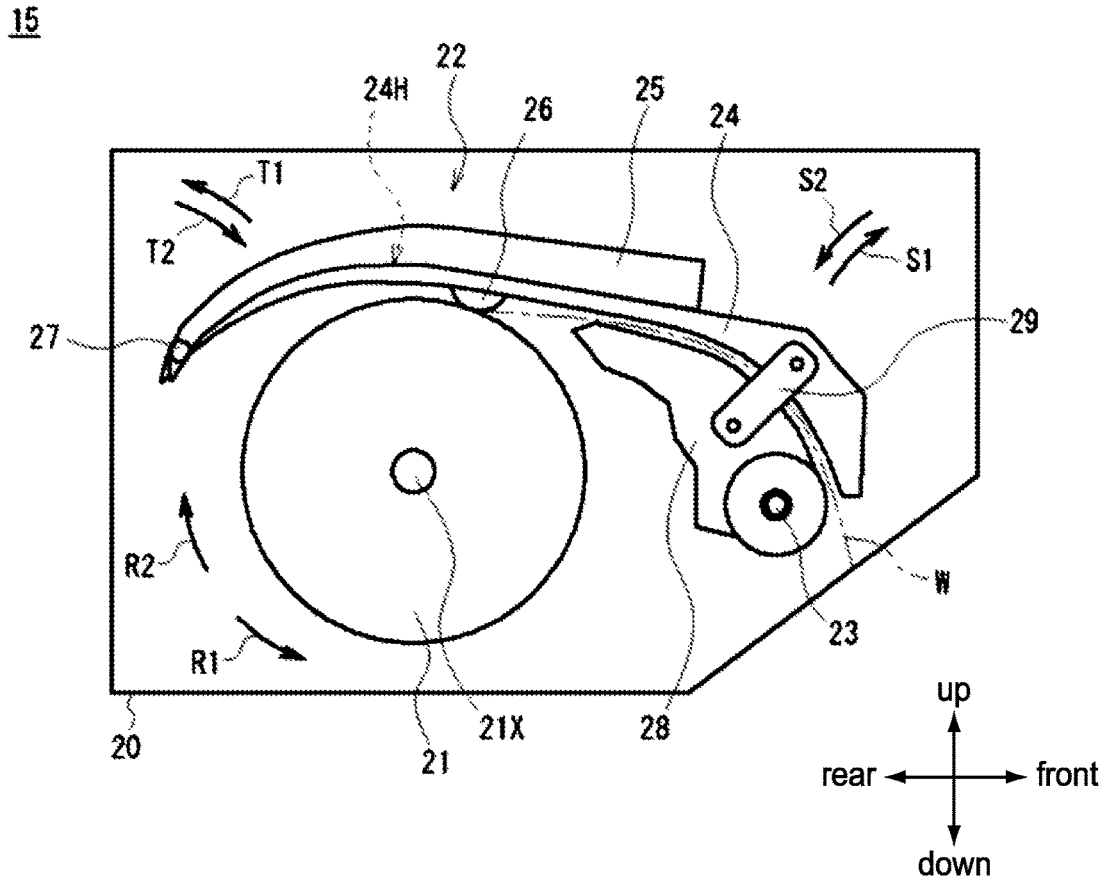
FIG. 4 is a schematic view showing internal structures of the temporary holding section.

As shown in FIG. 4, a cylindrical drum 21 is disposed at a central vicinity of the interior of the frame 20 of the temporary holding section 15. A central axis of the drum 21 is oriented in the left-and-right direction. Although FIG. 4 illustrates a left side view of the temporary holding section 15, for convenience of description, some components are made transparent and some components are omitted.

The drum 21 is mounted so as to be turnable in a winding direction R1 and an unwinding direction R2 about a central axis 21X along the left-and-right direction. Driving force from a motor, which is not shown in the drawings, is transmitted to the drum 21 via gears and the like, which are not shown in the drawings.

A conveyance guide 22 is disposed inside the temporary holding section 15. The conveyance guide 22 closes off the hole portion 20H and forms a conveyance path W for banknotes from the lower-front side to the upper side of the drum 21 at the middle of the interior of the temporary holding section 15. The conveyance guide 22 is structured to be turnable in an opening direction S1 and a closing direction S2 about a turning shaft 23, which is provided at the lower-front side thereof.

The conveyance guide 22 is structured by an opening guide frame 24 and an opening guide 25, which structure an upper side portion of the conveyance path W, and a transfer guide 28, which structures a lower side portion of the conveyance path W. The opening guide frame 24 and transfer guide 28 are fixed by a joining member 29 such that the conveyance path W is formed between the opening guide frame 24 and the transfer guide 28.

A middle portion of the opening guide frame 24 is formed to be flat, whereas a front side end portion and a rear side end portion of the opening guide frame 24 have shapes that are inflected downward. A large hole portion 24H is formed centrally in a region of the opening guide frame 24 that abuts against the upper side of the drum 21. The hole portion 24H penetrates up and down through this region of the opening guide frame 24. The shape of the opening guide frame 24 is formed such that a frame-shaped region is formed at the periphery thereof.

A roller 26 that turns freely is formed at a lower face side of the opening guide frame 24. In addition, plural rollers (not shown in the drawings) for conveying the banknotes are formed along the conveyance path W at the lower face side of the opening guide frame 24. Driving force from the motor, which is not shown in the drawings, is transmitted to some of the rollers. These rollers are driven independently of the drum 21.

The opening guide 25 is structured in a board shape overall. A front half portion of the opening guide 25 is formed to be flat, whereas a rear half portion is inflected downward.

The opening guide 25 is superposed with the upper side of the opening guide frame 24 so as to close off the hole portion 24H. The opening guide 25 is mounted to the opening guide frame 24 via a turning shaft 27, which is disposed in a vicinity of the front end of the opening guide 25.

The turning shaft 27 enables turning of the opening guide 25 in an opening direction T1 and a closing direction T2 relative to the opening guide frame 24.

When no external force is applied to the opening guide 25, the opening guide 25 turns in the closing direction T2 under its own weight and, as shown in FIG. 4, is disposed on the top of the drum 21. Thus, the opening guide 25 closes onto the top of the drum 21 and onto the opening guide frame 24. Hereinafter, this state is referred to as the closed state.

Figure 5:
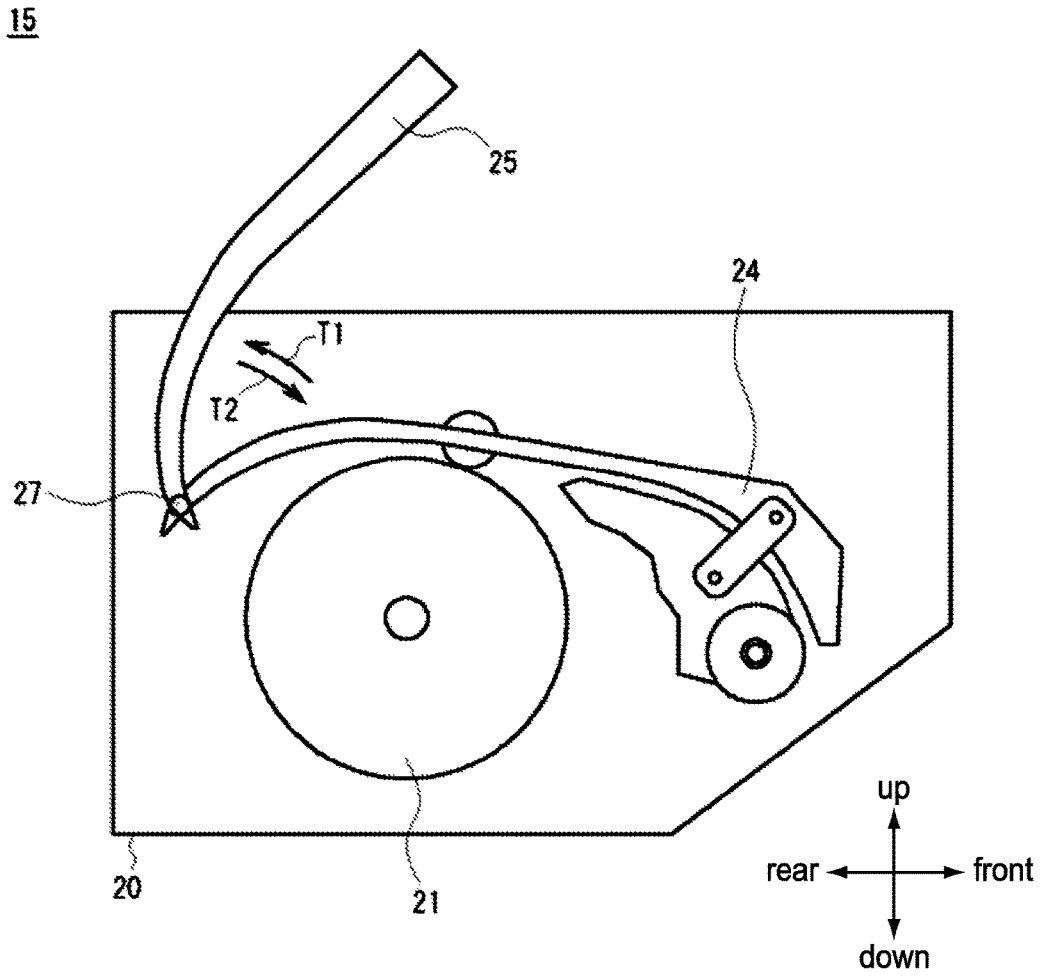
FIG. 5 is a schematic view showing opening of an open guide.

When an external force in the upward direction is applied to the opening guide 25 during maintenance operations or the like, the opening guide 25 turns in the opening direction T1 and, as shown in FIG. 5 corresponding to FIG. 4, opens apart from the top of the drum 21 and the hole portion 24H of the opening guide frame 24. Hereinafter, this state is referred to as the open state.

The transfer guide 28 (FIG. 4) is formed to be shorter in the front-and-rear direction than the opening guide frame 24. The transfer guide 28 is disposed below a front side portion of the opening guide frame 24. An upper face of the transfer guide 28 is curved so as to form an upward protruding curved surface. Plural rollers (not shown in the drawings) for conveying banknotes are provided at the upper face of the transfer guide 28, along the conveyance path W.

Two long, narrow tapes, which are not shown in the drawings, are provided inside the temporary holding section 15. The two tapes are wound onto reels, which are not shown in the drawings. The two tapes are fed out so as to run along a predetermined tape running path, reach to between the drum 21 and the roller 26 above and below the conveyance path W, and hence are fixed such that distal end portions thereof are superposed with one another at the periphery side face of the drum 21.

The conveyance guide 22 is urged in the closing direction S2 by the action of gravity, turns about the turning shaft 23, and is put into a state in which the roller 26 is abutted against the periphery side face of the drum 21. Therefore, even when the effective outer diameter of the drum 21 changes due to banknotes being wound onto the periphery side face thereof, the conveyance path W rear end of the conveyance guide 22 may be disposed on the periphery side face of the drum 21 at all times.

In the temporary holding section 15 according to this structure, when banknotes are to be stored, the drum 21 is turned in the winding direction R1 and banknotes transferred from the conveyance section 13 (FIG. 2) are conveyed along the conveyance path W to the upper side of the drum 21. The banknotes are nipped between the two tapes (not shown in the drawings), and in this state the banknotes are wound onto the periphery side face of the drum 21.

When the temporary holding section 15 is to feed out banknotes, the drum 21 is turned in the unwinding direction R2 and the two tapes are taken up onto the reels (not shown in the drawings). The banknotes that were wound onto the periphery side face of the drum 21 are separated therefrom, are conveyed forward along the conveyance path W, and are subsequently transferred to the conveyance section 13 (FIG. 2).

In addition to these structures, an operation knob 31 structured in a circular disc shape is provided at a left side face 20L (FIG. 3) of the temporary holding section 15. The operation knob 31 is exposed at the outer side of the left side face 20L. The operation knob 31 is linked with the drum 21. When the operation knob 31 is turned by hand by a technician during maintenance operations or the like, this force is transmitted to the drum 21 and causes the drum 21 to turn.

A knob cover 32 is also provided at the left side face of the temporary holding section 15, further to the left side (that is, the outer side) than the operation knob 31. The knob cover 32 covers the operation knob 31.

The knob cover 32 is formed overall in a plate shape that is thin in the left-and-right direction. The knob cover 32 is structured by a cover portion 32A, which is formed in a triangular shape, and an arm portion 32B, which extends upward in a long, narrow shape from an upper side corner portion of the cover portion 32A.

The cover portion 32A is formed with a size large enough to completely cover the left side of the operation knob 31. A circular rod-shaped knob cover turning shaft 33 is provided standing toward the right from roughly the middle of the arm portion 32B. A small, circular rod-shaped stud 34 is provided standing toward the right from a vicinity of an upper end of the arm portion 32B.

The knob cover turning shaft 33 is formed so as to be turnable relative to the left side face 20L of the frame 20, in an exposing direction U1, which is the clockwise direction if the knob cover 32 is viewed from the left side, and in the opposite direction, which is a covering direction U2. The knob cover 32 is urged in the exposing direction U1 by a spring 35.

Figure 6:
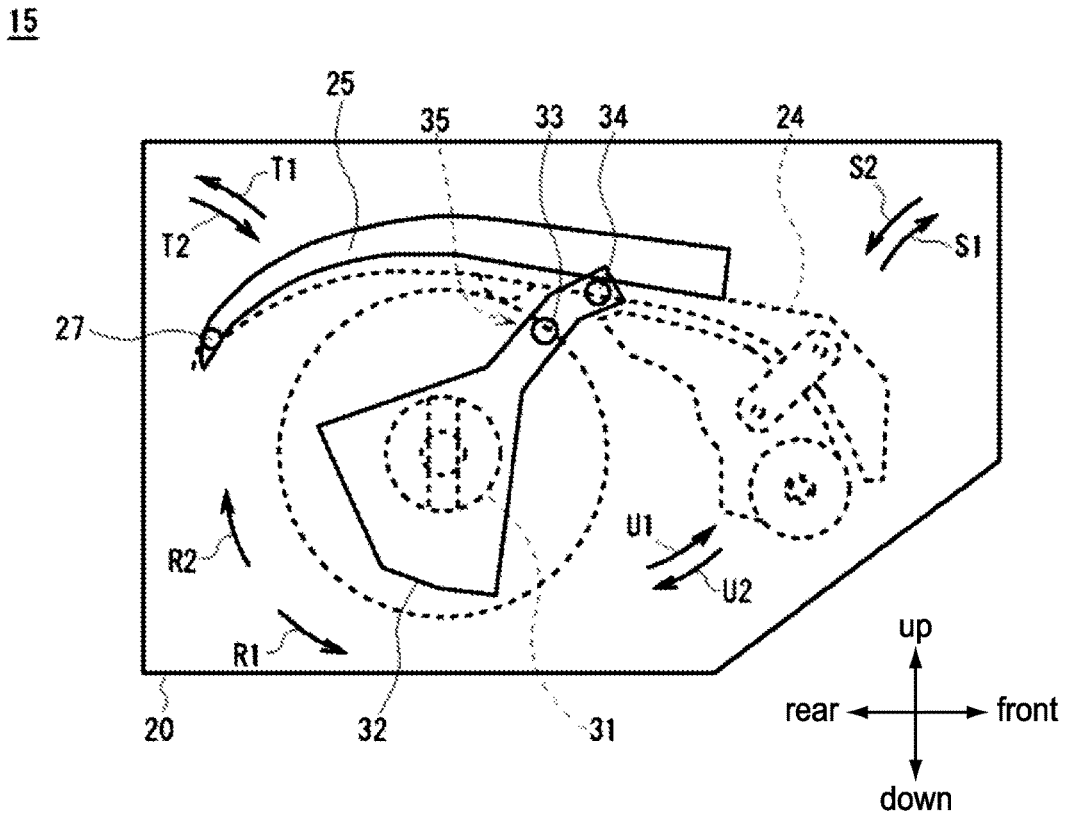
FIG. 6 is a schematic view showing a covering state in accordance with the first embodiment.

The stud 34 penetrates through a hole portion 20LH formed in the left side face 20L of the frame 20 and reaches the interior space of the frame 20. As shown in FIG. 6, an upper side portion of the stud 34 abuts against the lower face of the opening guide 25.

That is, although the knob cover 32 is urged in the exposing direction U1 by the spring 35, turning of the stud 34 in the exposing direction U1 is restricted by the stud 34 abutting against the opening guide 25. Thus, the knob cover 32 is in a state in which the operation knob 31 is covered by the cover portion 32A. Hereinafter, this state is referred to as the covering state.

However, when an external force in the upward direction is applied to the opening guide 25 during a maintenance operation or the like and the opening guide 25 is turned in the opening direction T1 from the closed state, the opening guide 25 is pulled away from the stud 34 and the restriction of the stud 34 of the knob cover 32 is released.

Figure 7:
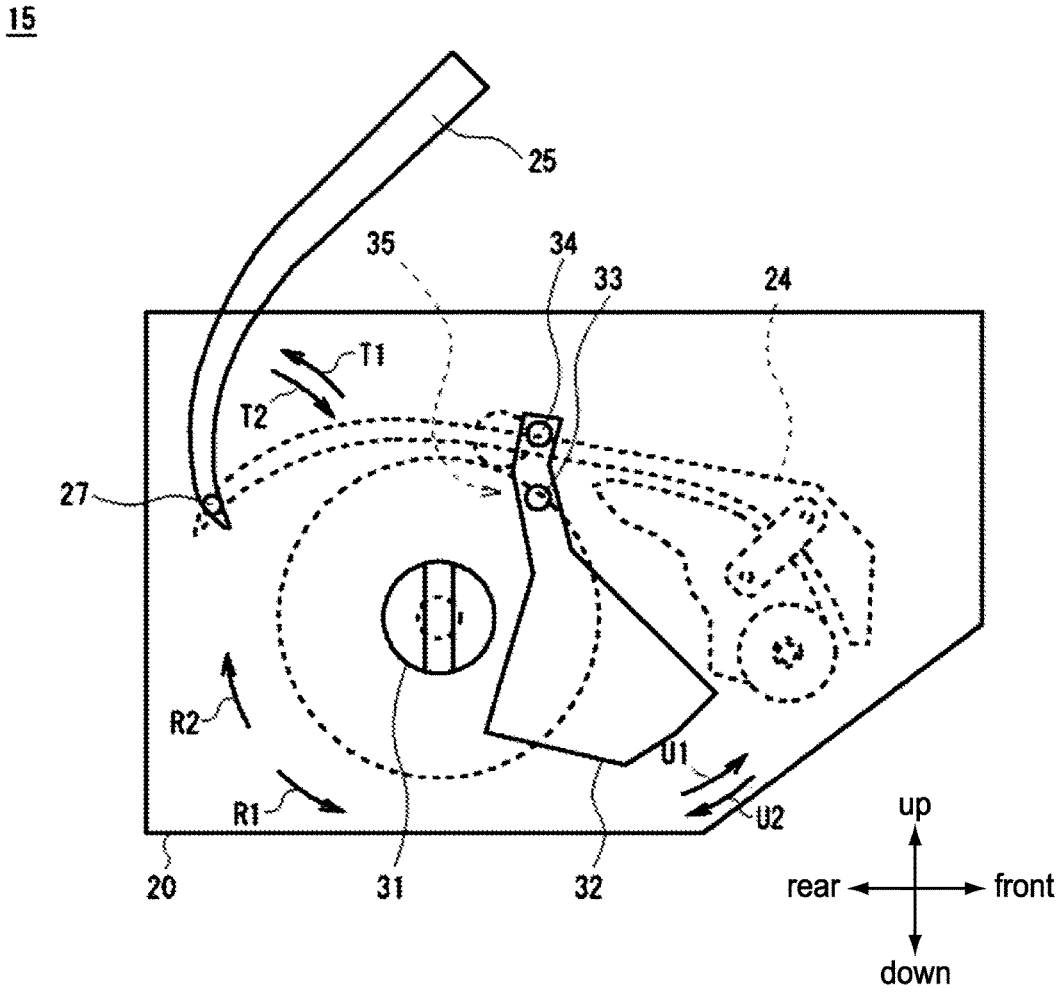
FIG. 7 is a schematic view showing an exposing state in accordance with the first embodiment.

As a result, the knob cover 32 is turned in the exposing direction U1 by the urging force of the spring 35 and, as shown in FIG. 7 corresponding to FIG. 6, the knob cover 32 is put into a state in which the operation knob 31 is exposed. Hereinafter, this state is referred to as the exposing state.

Thus, the knob cover 32 is structured so as to expose or cover the operation knob 31 by turning in the exposing direction U1 or the covering direction U2 in association with turning of the opening guide 25.

—1-3. Operation and Effects—

In the structure described above, the temporary holding section 15 according to the first embodiment is formed such that the opening guide 25 can be turned about the turning shaft 27 relative to the opening guide frame 24 of the conveyance guide 22 that covers the upper side of the drum 21.

Furthermore, the temporary holding section 15 is formed such that the operation knob 31 that turns the drum 21 is exposed at the outer side of the left side face 20L of the frame 20, and the outer side of the operation knob 31 is covered by the knob cover 32.

The knob cover 32 is mounted to be turnable about the knob cover turning shaft 33 relative to the left side face 20L of the frame 20, the knob cover 32 is urged in the exposing direction U1 by the spring 35, and the stud 34 of the knob cover 32 protrudes to the interior of the frame 20.

In the temporary holding section 15 according to this structure, in the closed state (FIG. 4), upward direction movement of the stud 34 is limited by the lower face of the opening guide 25, and consequently the knob cover 32 is kept in the covering state (FIG. 6).

Figure 8:
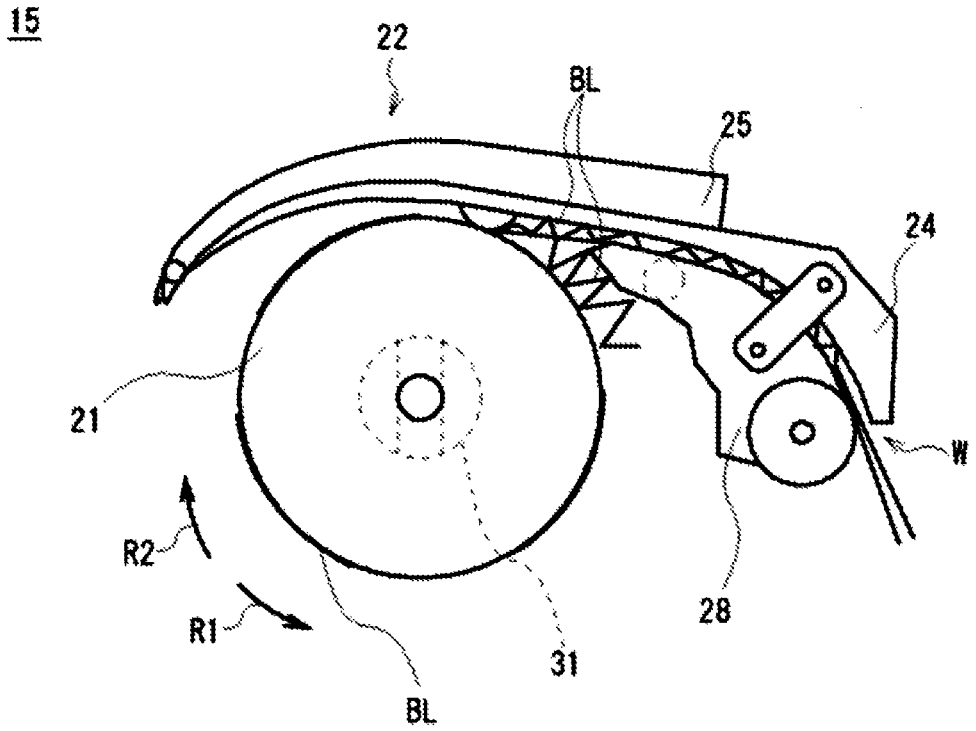
FIG. 8 is a schematic view showing jamming of a banknote in the temporary holding section.

In the temporary holding section 15, as shown in FIG. 8, a banknote BL may be jammed, for example, in the conveyance path W, between the drum 21 and the transfer guide 28, or the like. In this situation, an operation to remove the jammed banknote BL is carried out by a maintenance technician or the like as a maintenance operation at the temporary holding section 15.

In this maintenance operation, if banknotes BL have been wound onto the periphery side face of the drum 21, it is possible that the banknotes BL should be separated from the periphery side face by the maintenance technician turning the operation knob 31 and turning the drum 21 in the unwinding direction R2.

However, in this situation, because the opening guide 25 closes onto the upper side portion of the drum 21, there is a danger that the banknotes BL that are separated from the periphery side face of the drum 21 will successively jam at the upper side portion of the drum 21 and that the situation will be worsened. There is also a danger that the tapes, which are not shown in the drawings, will become jammed along with the banknotes BL or become tangled.

Accordingly, in the temporary holding section 15, the knob cover 32 is kept in the covering state (FIG. 6) when the opening guide 25 is in the closed state. Thus, operation of the operation knob 31 by a maintenance technician or the like may be restricted and manual turning of the drum 21 may be prevented.

On the other hand, when the opening guide 25 of the temporary holding section 15 is turned in the opening direction T1 from the closed state by a maintenance technician (FIG. 5), upward direction movement of the stud 34 is allowed. The knob cover 32 is turned in the exposing direction U1 by the action of the spring 35 and is put into the exposing state (FIG. 7). As a result, operation of the operation knob 31 of the temporary holding section 15 by the maintenance technician, that is, manual turning of the drum 21, is allowed.

At this time, the opening guide 25 of the temporary holding section 15 is not in the closed state and the upper side of the drum 21 is opened up. Therefore, when the maintenance technician turns the operation knob 31 of the temporary holding section 15 and the drum 21 is turned in the unwinding direction R2, banknotes BL separated from the periphery side face of the drum 21 may be released upward through the hole portion 24H of the opening guide frame 24, and there is no danger of the state of jamming being made worse.

In particular, operation of the operation knob 31 of the temporary holding section 15 is restricted not by an action on a linking mechanism between the operation knob 31 and the drum 21 inside the frame 20, or the like, but by the operation knob 31 being covered from the left side by the knob cover 32 in the covering state.

Therefore, at the temporary holding section 15, it is easy for a maintenance technician to visually recognize the fact that the operation knob 31 cannot be operated, and pointless operations of the operation knob 31 in the covering state (FIG. 6) may be effectively inhibited.

When the opening guide 25 of the temporary holding section 15 is turned in the opening direction T1 from the closed state, the knob cover 32 is automatically turned in the exposing direction U1 by the action of the spring 35 and is switched into the exposing state (FIG. 7).

Therefore, a maintenance technician need only perform the operation of lifting up the opening guide 25 of the temporary holding section 15 and turning the opening guide 25 in the opening direction T1; operation of the operation knob 31 may be allowed without the maintenance technician performing any operation on the knob cover 32.

In the temporary holding section 15 at this time, even if the opening guide 25 is not completely switched to the open state, the knob cover 32 may be switched into the exposing state at a stage at which the opening guide 25 is turned to some extent in the opening direction T1 from the closed state, because of the distance from the knob cover turning shaft 33 to the stud 34 and the like.

In particular, there may be situations in which the opening guide 25 of the temporary holding section 15 cannot be fully turned to the open state, because of the environment in which the automatic teller machine 1 is installed, interaction with other portions in maintenance operations, and the like.

However, even in such a situation, if a release path for the banknotes BL can be assured by the opening guide 25 of the temporary holding section 15 being lifted up from the closed state to some extent and the hole portion 24H of the opening guide frame 24 at the upper side of the drum 21 being opened up to some extent, the knob cover 32 may be put into the exposing state and operation of the operation knob 31 may be allowed.

When the opening guide 25 of the temporary holding section 15 is switched into the closed state, the knob cover 32 is automatically turned in the covering direction U2 and switched into the covering state by the stud 34 being pushed down (FIG. 6).

In particular, when the temporary holding section 15 is stowed into the casing 2 (FIG. 1) from a state in which the upper side unit 10A has been pulled out to the rearward (FIG. 2), if the opening guide 25 were in the open state, the opening guide 25 would interfere with the casing 2 (FIG. 1)

or other components or the like. Therefore, the opening guide 25 must be switched into the closed state.

Therefore, when the automatic teller machine 1 is to be operated, the opening guide 25 of the temporary holding section 15 is always returned to the closed state, and the knob cover 32 may always be returned to the covering state (FIG. 6) in association therewith.

Therefore, the knob cover 32 of the temporary holding section 15 may always be set in the covering state when the upper side unit 10A is pulled out to the rearward (FIG. 2) in a subsequent maintenance operation, and operation of the operation knob 31 may be assuredly prevented until the opening guide 25 is turned in the opening direction T1.

The knob cover 32 of the temporary holding section 15 is supported to be turnable relative to the left side face 20L of the frame 20 by the knob cover turning shaft 33, whose turning axis is oriented in the left-and-right direction.

Therefore, whether the knob cover 32 of the temporary holding section 15 is in the covering state, the exposing state or any state in between, the cover portion 32A may be kept substantially parallel with the left side face 20L of the frame 20, in the vicinity of the left side face 20L. Therefore, a protrusion amount of the knob cover 32 of the temporary holding section 15 from the left side face 20L may be kept small at all times. Thus, interference with other components and the like may be avoided, and an operation space for maintenance operations may be effectively assured.

Figure 9:
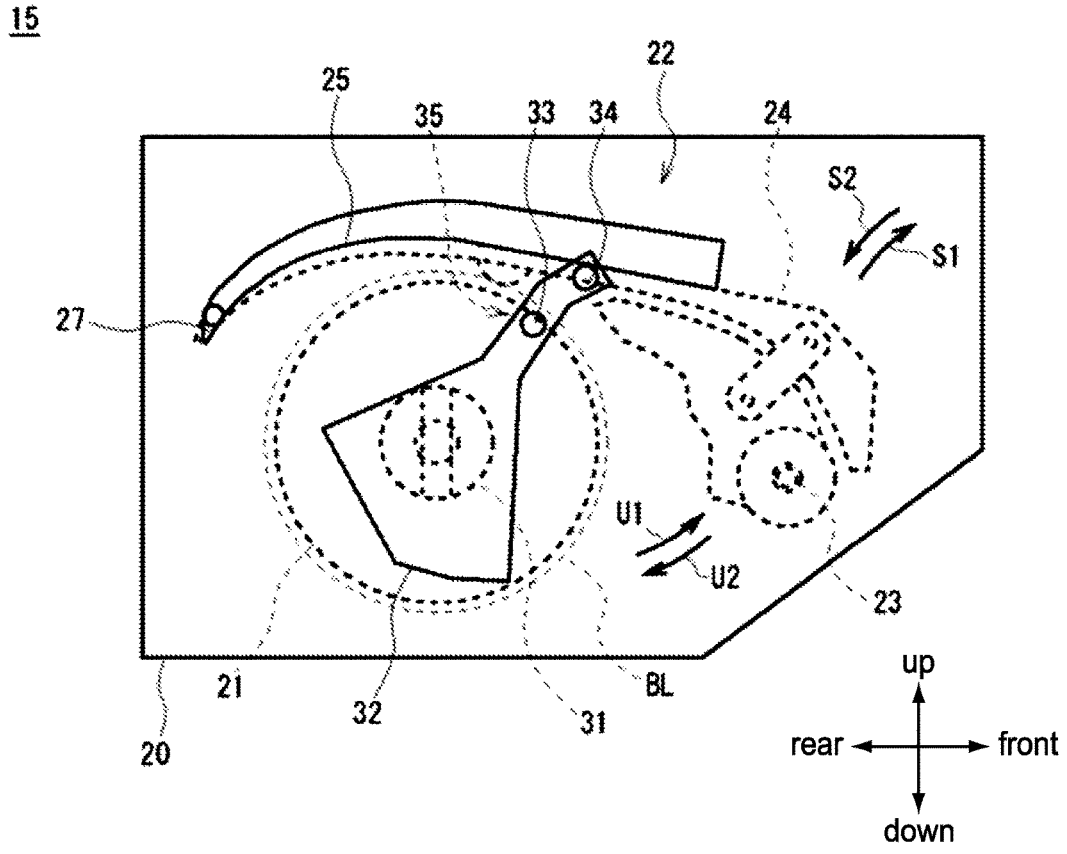
FIG. 9 is a schematic view showing turning of a knob cover as a result of a change in outer diameter of a drum.

When banknotes BL are being wound onto the periphery side face of the drum 21 of the temporary holding section 15, the effective outer diameter of the drum 21 increases. Correspondingly, the conveyance guide 22 turns in the opening direction S1 about the turning shaft 23, as shown in FIG. 9 corresponding to FIG. 6.

At this time, in accordance with the turning of the conveyance guide 22, the opening guide 25 turns a little in the upward direction, in accordance with which the knob cover 32 turns a little in the exposing direction U1. However, because the cover portion 32A of the knob cover 32 is formed to be large compared to the operation knob 31 (FIG. 3), the knob cover 32 may continue to cover the operation knob 31.

Relative to a conventional structure, the temporary holding section 15 requires only a slight increase in the number of components and minor modifications: the knob cover 32, the knob cover turning shaft 33 and the stud 34 are added and the hole portion 20LH is formed in the left side face 20L of the frame 20.

Thus, components that structure a conventional temporary holding section may almost all be used without modification for the temporary holding section 15. Therefore, work on new designs may be kept to a minimum, and the costs of fabrication and maintenance associated with the increase in the number of components may be kept extremely low.

According to the structure described above, in the temporary holding section 15 according to the first embodiment, the operation knob 31 that turns the drum 21 is exposed at the outer side of the left side face 20L, and the knob cover 32 is disposed at the outer side of the operation knob 31. When the opening guide 25 of the temporary holding section 15 is put into the closed state and closes onto the upper side of the drum 21, the knob cover 32, via the stud 34, is put into the covering state and operation of the operation knob 31 is prevented. Thus, the possibility of a degree of jamming of banknotes being worsened may be prevented. At another time, when the opening guide 25 of the temporary holding section 15 is turned in the opening direction T1 from the closed state and is opened apart from the upper side of the drum 21, the knob cover 32 is turned in the exposing direction U1 and put into the exposing state by the action of the spring 35. Hence, in addition to a release path for separated banknotes BL being assured, manual operation of the drum 21 by operation of the operation knob 31 may be allowed.

2. Second Embodiment

An automatic teller machine 101 according to the second embodiment (FIG. 1) differs from the automatic teller machine 1 according to the first embodiment in including a banknote deposit and withdrawal apparatus 110 instead of the banknote deposit and withdrawal apparatus 10, but has similar structures for other portions.

The banknote deposit and withdrawal apparatus 110 (FIG. 2) differs from the banknote deposit and withdrawal apparatus 10 according to the first embodiment in including a temporary holding section 115 instead of the temporary holding section 15, but has similar structures for other portions.

—2-1. Structure of the Temporary Holding Section—

Figure 10:
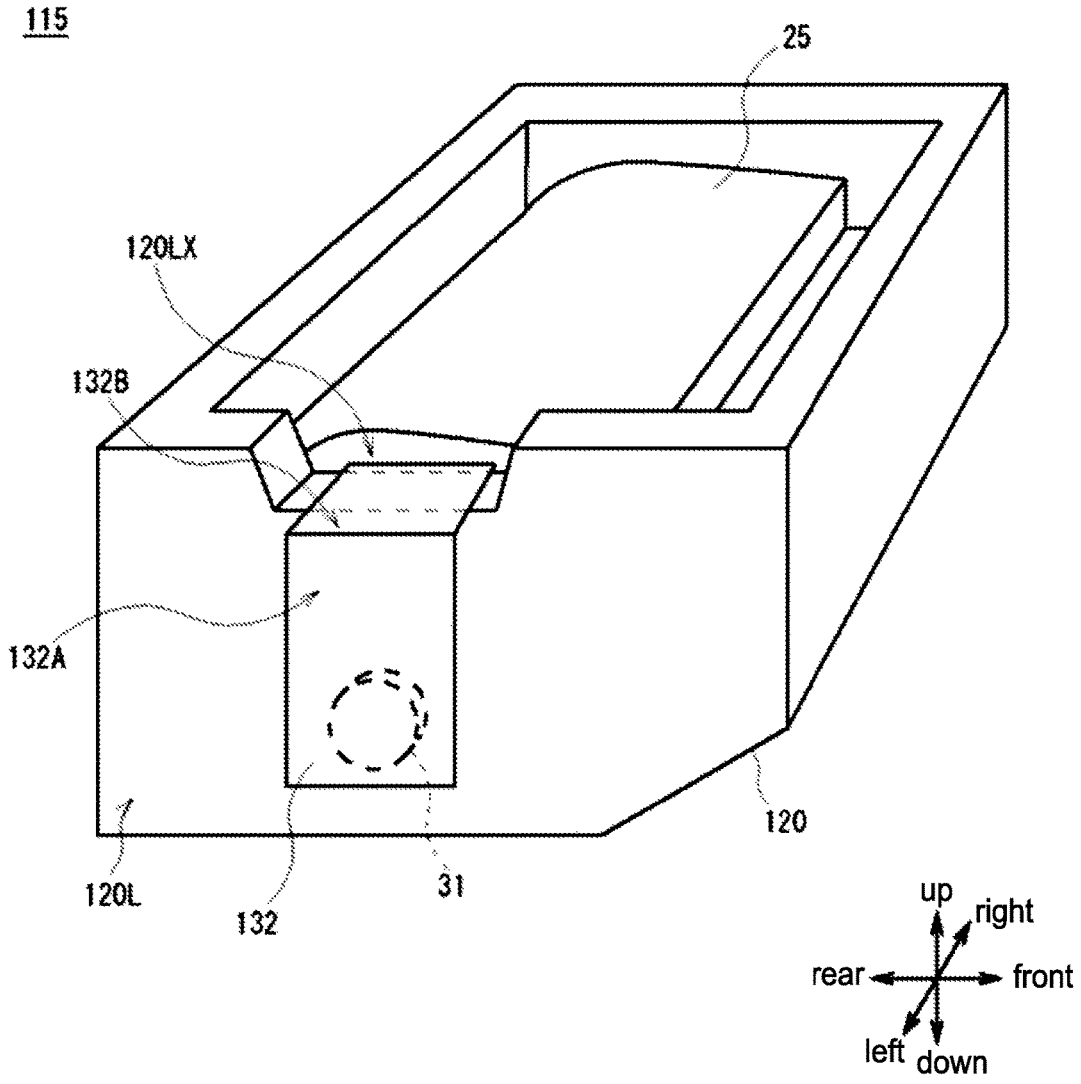
FIG. 10 is a schematic view showing structures of a temporary holding section in accordance with a second embodiment.

As shown in FIG. 10 corresponding to FIG. 3, the temporary holding section 115 has a structure in which the outer side is covered by a frame 120 instead of the frame 20, and the respective components are mounted thereinside.

The frame 120 has a similar overall structure to the frame 20, but differs in that a cutaway portion 120LX is formed at the upper side of a left side face 120L. The cutaway portion 120LX is cut away in a trapezoid shape.

The temporary holding section 115 also differs from the temporary holding section 15 according to the first embodiment in including a knob cover 132 instead of the knob cover 32, knob cover turning shaft 33 and stud 34, but has similar structures for other portions.

The knob cover 132 is formed of a thin plate-shaped member and is structured by a support portion 132B and a cover portion 132A. The support portion 132B extends substantially horizontally in the leftward direction from a left side face of the opening guide 25. The cover portion 132A extends in the downward direction from a portion that is at the left side relative to the operation knob 31.

Figure 11:
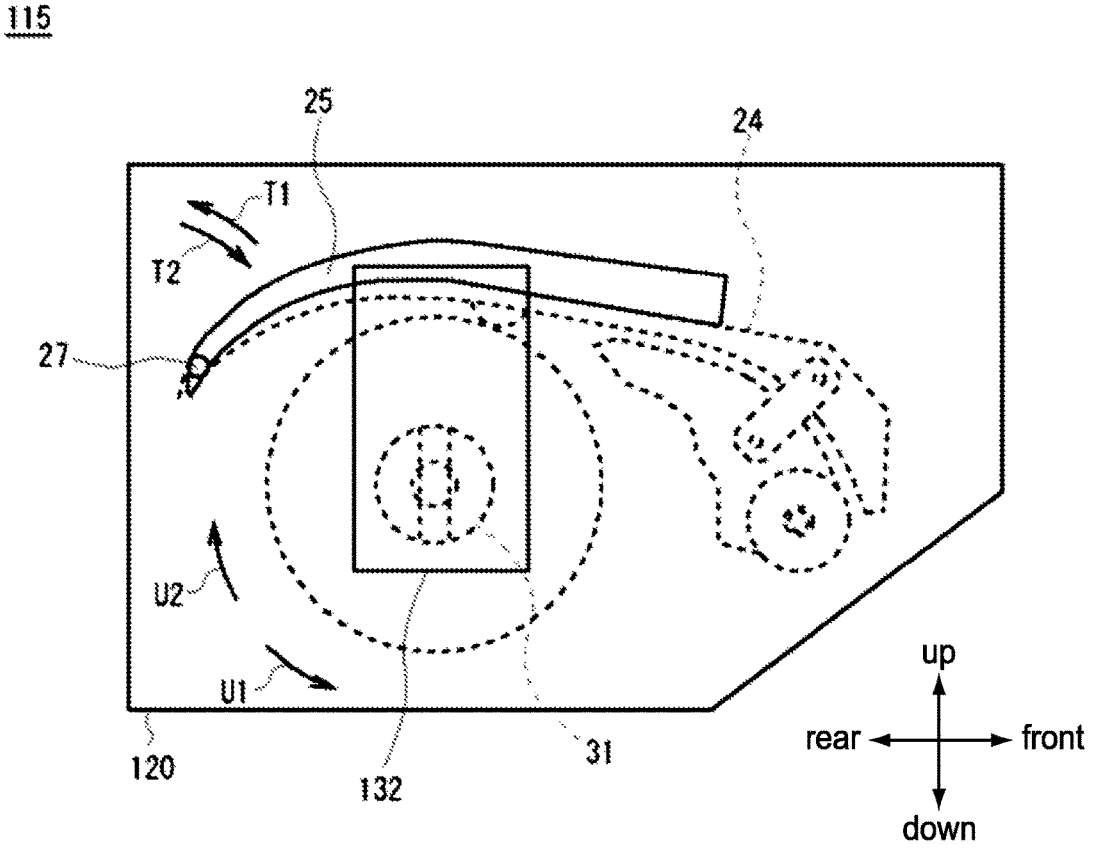
FIG. 11 is a schematic view showing a covering state in accordance with the second embodiment.

That is, as shown in FIG. 11 corresponding to FIG. 6, when the opening guide 25 is in the closed state, the knob cover 132 is in a state in which the cover portion 132A completely covers the operation knob 31 from the left side thereof. Hereinafter, this state is referred to as the covering state in the present embodiment.

On the other hand, when the opening guide 25 is turned in the opening direction T1 from the closed state, the knob cover 132 is lifted in the upward direction by turning integrally with the opening guide 25 about the turning shaft 27.

Figure 12:
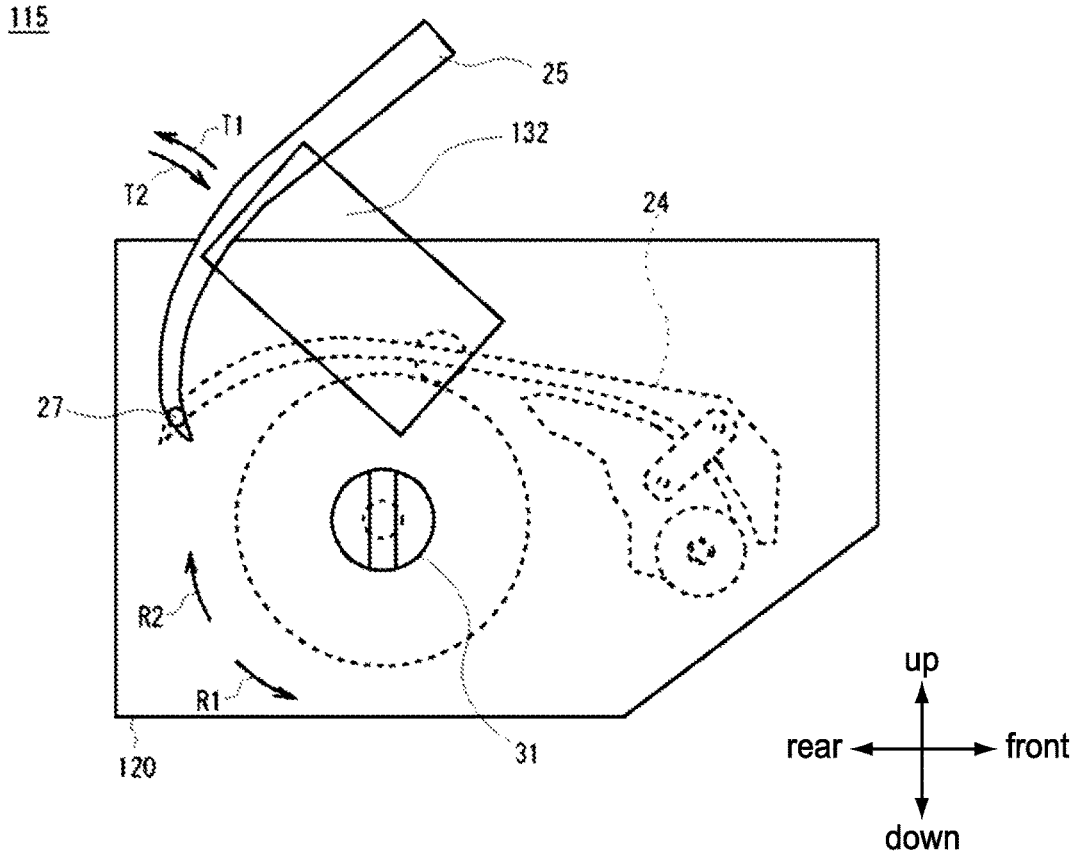
FIG. 12 is a schematic view showing an exposing state in accordance with the second embodiment.

At this time, as shown in FIG. 12 corresponding to FIG. 7, the knob cover 132 is put into a state in which the cover portion 132A is completely withdrawn from the left side of the operation knob 31 and exposes the operation knob 31. Hereinafter, this state is referred to as the exposing state in the present embodiment.

Thus, because the knob cover 132 of the temporary holding section 115 is attached to the opening guide 25, the knob cover 132 may be switched between the covering state that covers the operation knob 31 and the exposing state that exposes the operation knob 31 in accordance with opening and closing of the opening guide 25.

—2-2. Operation and Effects—

In the temporary holding section 115 according to the second embodiment with the structure described above, similarly to the first embodiment, the opening guide 25 may be turned about the turning shaft 27 relative to the opening guide frame 24 of the conveyance guide 22 that covers the upper side of the drum 21.

The temporary holding section 115 is formed such that the operation knob 31 that turns the drum 21 is exposed at the outer side of the left side face 120L of the frame 120 and the outer side of the operation knob 31 is covered by the knob cover 132 attached to the left side of the opening guide 25.

Therefore, when the opening guide 25 of the temporary holding section 115 is in the closed state, the cover portion 132A is in the covering state completely covering the operation knob 31 from the left side, and operation of the operation knob 31 may be restricted.

When the opening guide 25 of the temporary holding section 115 is not in the closed state, the cover portion 132A is completely withdrawn from the left side of the operation knob 31 and put into the exposing state. Thus, operation of the operation knob 31 by a maintenance technician, which is to say turning of the drum 21 by manual operation, may be allowed.

In particular, relative to a conventional temporary holding section, the temporary holding section 115 may be structured simply by forming the cutaway portion 120LX in the left side face 120L of the frame 120 and attaching the knob cover 132 to the opening guide 25. Thus, the temporary holding section 115 does not lead to remarkable design modifications or a remarkable increase in the number of components.

In other respects, the temporary holding section 115 according to the second embodiment may realize the same operational effects as the temporary holding section 15 according to the first embodiment.

According to the structure described above, in the temporary holding section 115 according to the second embodiment, the operation knob 31 that turns the drum 21 is exposed at the outer side of the left side face 120L, and the cover portion 132A of the knob cover 132 that is attached to the left side of the opening guide 25 is disposed at the outer side of the operation knob 31. Therefore, when the opening guide 25 of the temporary holding section 115 is in the closed state and closes onto the upper side of the drum 21, the knob cover 132 is in the covering state and operation of the operation knob 31 is prevented. Thus, the possibility of a degree of jamming of banknotes being worsened may be prevented. At another time, when the opening guide 25 of the temporary holding section 115 is turned in the opening direction T1 from the closed state, the knob cover 132 is put into the exposing state. Hence, in addition to a release path for separated banknotes BL being assured, manual operation of the drum 21 by operation of the operation knob 31 may be allowed.

3. Alternative Embodiments

In the first embodiment described above, a case is described in which the knob cover 32 can be turned about the knob cover turning shaft 33 relative to the left side face 20L of the frame 20, and in the second embodiment a case is described in which the knob cover 132 is attached to the opening guide 25 and turns integrally with the opening guide 25.

However, the present invention is not limited thus. For example, a knob cover may be made turnable about a turning shaft whose turning axis is oriented in the front-and-rear direction, the up-and-down direction or the like, or the left side face 20L of the frame 20 may be made movable in the up-and-down direction, the front-and-rear direction or the like in association with turning of the opening guide 25. In other words, it is sufficient if the knob cover is in the covering state when the opening guide 25 is in the closed state and the knob cover is in the exposing state when the opening guide 25 is turned in the opening direction T1 from the closed state.

In the first embodiment described above, a case is described in which the knob cover 32 is urged in the exposing direction U1 by the spring 35.

However, the present invention is not limited thus. By an adjustment of the position of the center of gravity of the knob cover 32 relative to the knob cover turning shaft 33, the knob cover 32 may be formed to be urged in the exposing direction U1 by its own weight or, conversely, the knob cover 32 may be urged in the covering direction U2, or may be urged in some other direction.

In the first embodiment described above, a case is described in which the opening guide 25 is turned in the closing direction T2 by its own weight when no external force is applied thereto.

However, the present invention is not limited thus. For example, a spring that urges the opening guide 25 in the opening direction T1 may be assembled to the turning shaft 27 and a locking mechanism that keeps the opening guide 25 in the closed state may be mounted at a predetermined portion of the opening guide frame 24. Thus the opening guide 25 may be automatically turned in the opening direction T1 when locking by the locking mechanism is released. The same is applicable to the second embodiment.

In the first embodiment described above, a case is described in which the opening guide 25 switches between the closed state and the open state by turning about the turning shaft 27 that is disposed in a vicinity of the rear end of the opening guide frame 24.

However, the present invention is not limited thus. For example, the opening guide 25 may be turned about a turning shaft that is disposed at the front side of the opening guide frame 24, or at both left and right sides or the like. Alternatively, the opening guide 25 may be opened and closed via a widely known linking mechanism, sliding mechanism or the like. In other words, it is sufficient that the opening guide 25 can be switched between the closed state and the open state. Furthermore, the opening guide 25 is not limited to a single plate shape but may be divided into two or more plates at times of opening. The same is applicable to the second embodiment.

In the first embodiment described above, a case is described in which the hole portion 20H is formed in the upper face of the frame 20, that is, at the upper side of the drum 21, and the conveyance guide 22 is provided so as to cover the hole portion 20H.

However, the present invention is not limited thus. For example, The hole portion 20H may be formed in a front face, a rear face or the like of the frame 20, or in another side face, and the conveyance guide 22 may be provided so as to cover this hole portion 20H. In this case, as an example, a spring may be assembled to the turning shaft 23 and the conveyance guide 22 may be pressed against the drum 21 by this spring.

In the first embodiment described above, a case is described in which the operation knob 31 is disposed at the left side relative to the left side face 20L of the frame 20.

However, the present invention is not limited thus. For example, the operation knob 31 may be retracted to the right side relative to the left side face 20L of the frame 20 and a relatively large operation hole cut into the left side face 20L. In this case, because the knob cover 32 is disposed at the right side relative to the left side face 20L, the knob cover 32 may also function as a shutter for the operation hole.

In the first embodiment described above, a case is described in which the opening guide 25 abuts against the stud 34 only when the opening guide 25 is in the closed state or a nearby state, and the opening guide 25 is separated from the stud 34 when the opening guide 25 is in the open state or a nearby state.

However, the present invention is not limited thus. The opening guide 25 may abut against the stud 34 at all times. Further, a widely known linking mechanism, gear mechanism or the like may be provided instead of the stud 34.

In the first embodiment described above, a case is described in which the conveyance guide 22 turns about the turning shaft 23 in accordance with an amount of mediums wound onto the periphery side face of the drum 21, that is, in accordance with the effective outer diameter of the drum 21.

However, the present invention is not limited thus. The conveyance guide 22 may be fixed relative to the frame 20. The same is applicable to the second embodiment.

In the first embodiment described above, a case is described in which the knob cover 32 operates in conjunction with opening and closing of the opening guide 25: when the opening guide 25 is in the closed state, the knob cover 32 is in the covering state and manual operation of the drum 21 is prevented by the knob cover 32 covering the operation knob 31.

However, the present invention is not limited thus. Turning operation of the drum 21 when the opening guide 25 is in the closed state may be prevented by various mechanisms that can be operated in conjunction with opening and closing of the opening guide 25, such as, for example, a mechanism that locks and releases turning of the operation knob 31, a mechanism that connects and disconnects the operation knob 31 with the drum 21, and the like.

In the first embodiment described above, a case is described in which the present invention is applied to the temporary holding section 15 that is installed in the automatic teller machine 1, which processes transactions relating to cash with customers in a financial institution or the like.

However, the present invention is not limited thus. For example, the present invention may be applied to temporary holding sections installed in various devices that handle banknotes, such as a banknote processing device (a "teller machine") used by counter staff at the counter of a financial institution or such, or the like. Moreover, the mediums temporarily held in the temporary holding section 15 are not limited to the banknotes BL. For example, the present invention may be applied to temporary holding sections that temporarily hold various sheet-form mediums, such as security certificates, gold certificates and the like. The same is applicable to the second to fourth embodiments.

In the embodiments described above, a case is described in which the temporary holding section 15 serving as the medium processing device is structured by the drum 21 serving as a drum, the frame 20 serving as a frame, the opening guide 25 serving as a guide, the turning shaft 27 serving as a support portion, the operation knob 31 serving as an operation knob, and the knob cover 32 serving as a knob cover.

However, the present invention is not limited thus. The medium processing device may be structured by a drum, frame, guide, support portion, operation knob and knob cover with various alternative structures.

In the embodiments described above, a case is described in which the automatic teller machine 1 serving as the medium transaction device is structured by the conveyance section 13 serving as a conveyance section, the drum 21 serving as the drum, the frame 20 serving as the frame, the opening guide 25 serving as the guide, the turning shaft 27 serving as the support portion, the operation knob 31 serving as the operation knob, and the knob cover 32 serving as the knob cover.

However, the present invention is not limited thus. The medium transaction device may be structured by a conveyance section, drum, frame, guide, support portion, operation knob and knob cover with various alternative structures.

The disclosures of Japanese Patent Application No. 2012-278448 are incorporated into the present specification by reference in their entirety.

All references, patent applications and technical specifications cited in the present specification are incorporated by reference into the present specification to the same extent as if the individual references, patent applications and technical specifications were specifically and individually recited as being incorporated by reference.

INDUSTRIAL APPLICABILITY

The present invention is applicable to various devices that store sheet-form mediums by winding the mediums onto a periphery side face of a drum.

The invention claimed is:

1. A medium processing device, comprising:

a drum in a cylindrical shape, sheet-form mediums being wound onto a periphery side face of the drum;

a frame that screens the surroundings of the drum from outside the frame, an opening hole through which the mediums can be extracted to the outside being formed in the frame;

a guide that guides the mediums in a vicinity of the periphery side face of the drum;

a support portion that supports the guide to be switchable between a closed state in which the opening hole is covered by the guide and an open state in which the opening hole is open;

an operation knob provided adjacent to one side face of the frame, the operation knob transmitting a turning operation applied from the outside to the drum;

a knob cover that is in a covering state of covering the operation knob when the guide is in the closed state, and that is in an exposing state in which the operation knob is exposed when the guide is in the open state; and a linking structure that moves the knob cover between the covering state with movement of the guide to the closed state, and the exposing state with movement of the guide to the open state.

2. The medium processing device according to claim 1, further comprising a knob cover turning shaft that supports the knob cover to be turnable relative to the frame.

3. The medium processing device according to claim 2, wherein the linking structure includes;

an urging portion that urges the knob cover in a direction of exposing the operation knob.

4. The medium processing device according to claim 3, wherein the opening hole is formed in the frame at an upper side of the drum, and when the guide is in the closed state, the knob cover is switched to the covering state by its own weight.

5. The medium processing device according to claim 2, wherein the knob cover is movable in a direction substantially parallel with the one side face of the frame at which the operation knob is provided.

6. The medium processing device according to claim 1, wherein the guide is linked, via the linking structure, with the knob cover when the guide is in the closed state, and the linking with the knob cover is released when the guide is in the open state.

7. The medium processing device according to claim 1, wherein, in the closed state, the guide relative to the frame is displaced in accordance with an amount of the mediums wound onto the periphery side face of the drum, and the knob cover maintains the covering state of covering the operation knob even when the guide in the closed state is displaced in accordance with the amount of the mediums wound onto the periphery side face of the drum.

8. The medium processing device according to claim 1, wherein the knob cover is attached to the guide.

9. The medium processing device according to claim 1, further comprising a knob cover turning shaft that supports the knob cover to be turnable relative to the frame;

wherein the linking structure allows the knob cover to turn in a direction of the exposing state from the covering state, with turning of the guide to a direction of the open state from the closed state, wherein the linking structure allows the knob cover to turn in a direction of the covering state from the exposing state, with turning of the guide to a direction of the closed state from the open state.

10. A medium transaction device, comprising:

a conveyance section that conveys sheet-form mediums;

a drum in a cylindrical shape, the mediums being wound onto a periphery side face of the drum;

a frame that screens the surroundings of the drum from outside the frame, an opening hole through which the mediums can be extracted to the outside being formed in the frame;

a guide that guides the mediums between the conveyance section and a vicinity of the periphery side face of the drum;

a support portion that supports the guide to be switchable between a closed state in which the opening hole is covered by the guide and an open state in which the opening hole is open;

an operation knob provided adjacent one side face of the frame, the operation knob transmitting a turning operation applied from the outside to the drum;

a knob cover that is in a covering state of covering the operation knob when the guide is in the closed state, and that is in an exposing state in which the operation knob is exposed when the guide is in the open state; and a linking structure that moves the knob cover between the covering state with movement of the guide to the closed state, and the exposing state with movement of the guide to the open state.

11. The medium transaction device according to claim 10, further comprising a knob cover turning shaft that supports the knob cover to be turnable relative to the frame;

wherein the linking structure allows the knob cover to turn in a direction of the exposing state from the covering state, with turning of the guide to a direction of the open state from the closed state, wherein the linking structure allows the knob cover to turn in a direction of the covering state from the exposing state, with turning of the guide to a direction of the closed state from the open state.

* * * * *